United States Patent [19]

Glendowne

[11] Patent Number: 4,769,949

[45] Date of Patent: Sep. 13, 1988

[54] TUB AND SHOWER DOOR ENCLOSURE HAVING FREE-FLOATING SELF-ADJUSTING LOWER GUIDE ASSEMBLY

[75] Inventor: Richard R. Glendowne, Newbern, Tenn.

[73] Assignee: USG Industries, Inc., Chicago, Ill.

[21] Appl. No.: 54,269

[22] Filed: May 26, 1987

[51] Int. Cl.[4] ..... E05D 13/00

[52] U.S. Cl. ..... 49/410; 16/90; 4/557

[58] Field of Search ..... 49/410, 411; 16/90, 16/91; 4/557, 607, 610

[56] References Cited

U.S. PATENT DOCUMENTS

| | | | |
|---|---|---|---|
| Re. 24,508 | 3/1954 | Grossman | 189/46 |
| 854,789 | 5/1907 | Woyak . | |
| 1,793,923 | 2/1931 | Fry | 49/410 |
| 1,895,856 | 10/1929 | Madland . | |
| 2,095,645 | 5/1937 | Lewis | 4/149 |
| 2,148,310 | 2/1939 | Talen | 16/90 |
| 3,074,077 | 6/1960 | Taubman | 4/149 |
| 3,111,208 | 4/1961 | Grossman | 189/46 |
| 3,261,129 | 7/1966 | Brydolf | 49/410 |
| 3,359,573 | 11/1964 | Casebolt | 4/149 |
| 3,384,998 | 5/1968 | Abramson | 49/411 |
| 3,653,157 | 4/1972 | Casebolt | 49/411 |
| 3,683,451 | 8/1972 | Tanner | 16/90 |
| 3,701,179 | 10/1972 | Cox | 16/90 |
| 4,228,560 | 10/1980 | Baus | 16/90 |
| 4,358,863 | 11/1982 | Jacobsen | 4/607 |
| 4,445,239 | 5/1984 | Jacobsen | 4/607 |
| 4,458,449 | 7/1984 | Breuer | 49/411 |

FOREIGN PATENT DOCUMENTS

| | | | |
|---|---|---|---|
| 0604731 | 9/1960 | Canada | 49/411 |

*Primary Examiner*—Kenneth J. Dorner
*Assistant Examiner*—Gerald A. Anderson
*Attorney, Agent, or Firm*—John M. Lorenzen; Robert H. Robinson; Samuel Kurlandsky

[57] ABSTRACT

A shower door mounted on rails for movement thereon and having a lower guide assembly which is free-floating and which comprises a flange retained in a lower sill track slot and having the other end hingedly mounted on a flange of the shower door.

5 Claims, 3 Drawing Sheets

TUB AND SHOWER DOOR ENCLOSURE HAVING FREE-FLOATING SELF-ADJUSTING LOWER GUIDE ASSEMBLY

BACKGROUND OF THE INVENTION

1. Field of the Invention

The present relates to structures for mounting a slidable shower door on rails for movement thereon, and more particularly referes to a structure having a lower guide assembly which is free-floating and which is retained in a lower guide slot when the doors on which it is mounted are opened and closed.

2. Description of the Prior Art

Movable door assemblies are generally formed of one or more doors each comprising a frame in which a panel of a plastic material or glass is mounted. The doors have hangers affixed at the top of each door provided with glides or rollers mounted on the hangers, each glide or roller being movably supported on a fixed track. At the bottom of the doors are provided an assortment of different types of guides for preventing the lower portion of the door from being displaced out of vertical position and permitting water from the shower or tub to flow out the structure. Some of the lower guides provided in the prior art have been of such nature that they are easily derailed upon violent movement of the door which they guide. Other structures disclosed in the art are of such nature that they permit the accumulation of dirt and debris at the bottom of the door.

SUMMARY OF THE INVENTION

It is an object of the present invention to provide a sliding closure assembly for a tub or shower door having a guide assembly which guides the lower portion of the door precisely and doesn't permit it to leave the sill structure in which it is guided.

It is a further object of the invention to provide a lower guide assembly for a shower door which does not cause the accumulation of water and debris at the bottom of the door.

It is still further an object to provide a lower guide assembly which is free floating and therefore compensates for minor discrepancies in the elevation of the structure.

It is still further an object of the invention to provide a lower guide assembly of the type described which provides a smooth operation with respect to the lower edge of the door. The guide is installed and/or removed after the frame #16, 14, 17, 18 and panels 25, 26 are installed.

These and other objects, advantages and functions of the invention will be apparent upon reference to the specification and to the attached drawings illustrating preferred embodiments of the invention, in which like parts are identified by like reference symbols in each of the views.

DESCRIPTION OF THE PREFERRED EMBODIMENTS

Figure 1:
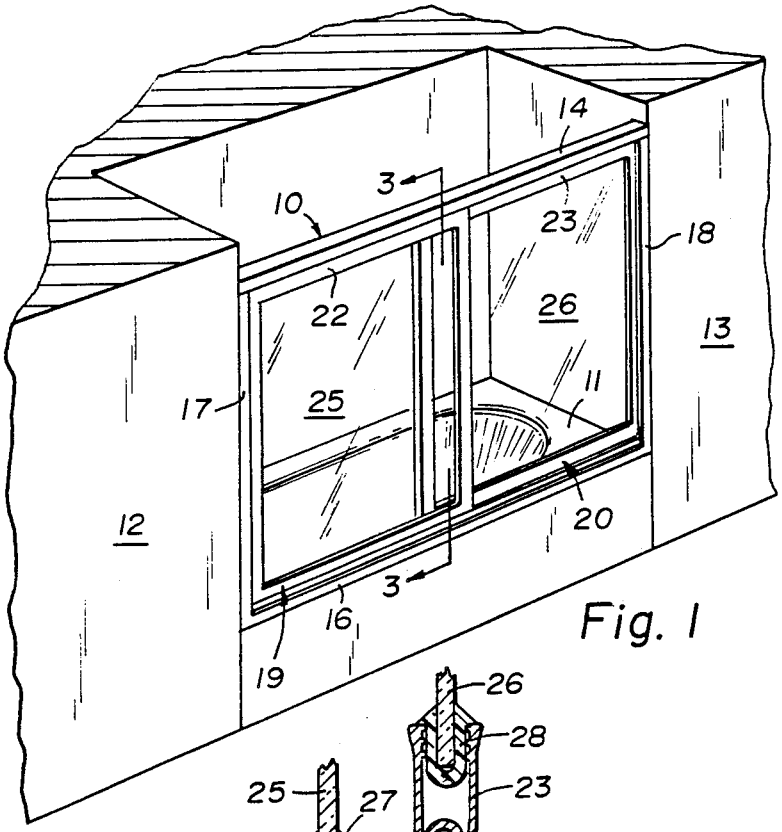
FIG. 1 is a view of a tub enclosure provided with moveable doors according to the invention.

Referring to the drawings and particularly FIG. 1, a tub enclosure 10 is shown mounted on a bathtub 11 between bathroom walls 12 and 13. A long front header or supporting member 14 is mounted between the walls. A sill track 16 is mounted on the tub. End jambs 17 and 18 are mounted on the walls 12 and 13, respectively.

Doors 19 and 20 are mounted on the enclosure, having door frames 22 and 23, and glass panels 25 and 26 retained in the frames 22 and 23 by means of resilient gaskets 27 and 28, respectively.

Figure 2:
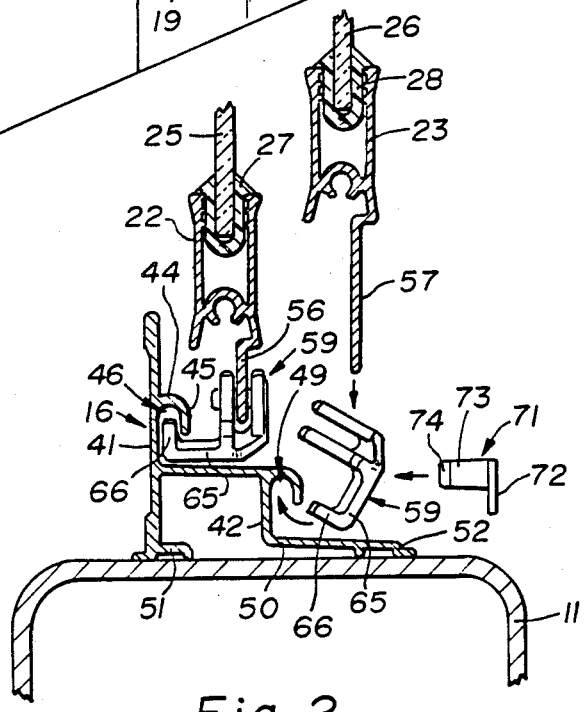
FIG. 2 is a cross-sectional view of a portion of the structure shown in FIG. 1, partially in exploded form.
Figure 3:
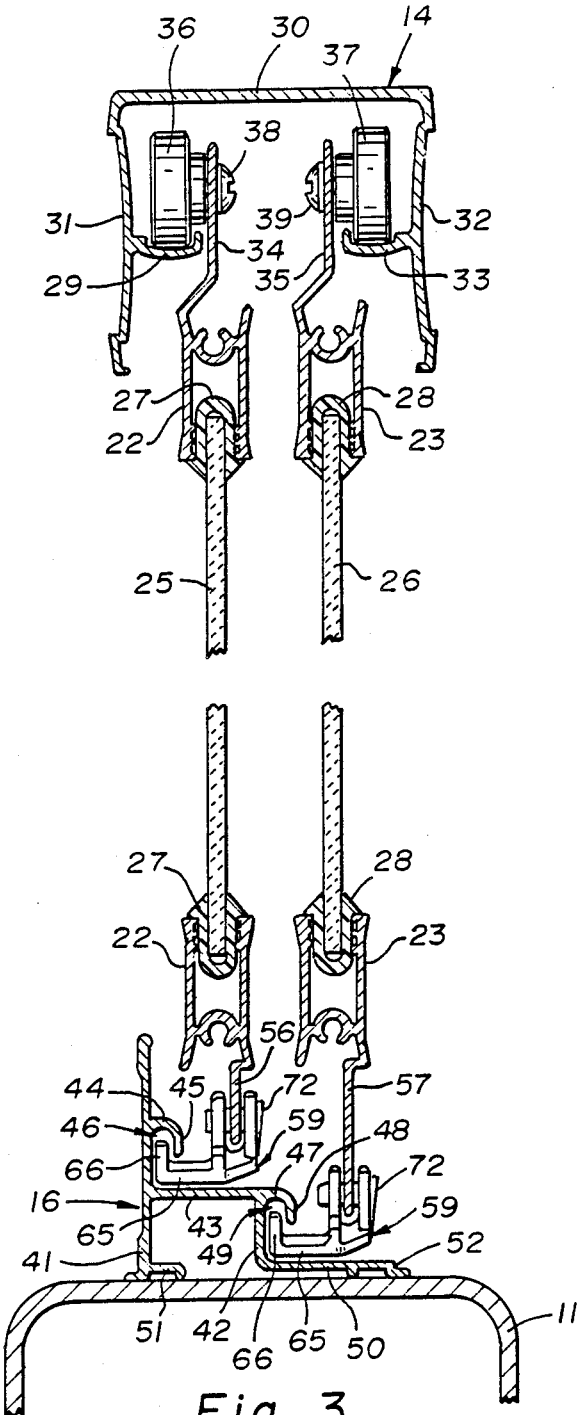
FIG. 3 is a cross-sectional view of a portion of the structure shown in FIG. 1 taken at the line 3—3 of FIG. 1, looking in the direction of the arrows.

Referring to FIGS. 2 and 3, the structure of the present invention is shown in detail and comprises the header 14 formed of a web 30 and lateral flanges 31 and 32. The flanges have integral tracks 29 and 33 supporting rollers 36 and 37. The door frames 22 and 23 are provided with suspension flanges 34 and 35 which have bolts 38 and 39 affixing the rollers 36 and 37 to the suspension flanges 34 and 35, respectively: The lower portions of the door frames 22 and 23 are provided with guide flanges 56 and 57.

The sill track 16 is formed of a forward vertical wall 41, a rearward vertical wall 42 of smaller dimension, and a supporting platform 43 connecting the forward vertical wall 41 to the rearward vertical wall 42. The supporting platform 43 descends toward the inner portion of the tub 11 to permit the drainage of water into the tub. An upper guide flange 44 extends from an upper portion of the vertical wall 41 and curves to provide a vertical flange member 45 cooperating with the vertical wall 41 to define a downwardly directed guide channel 46. At the upper end of the rearward vertical wall 42 a lower guide flange 47 extends laterally and terminates in a vertical flange member 48 cooperating with the rearward vertical wall 42 to define a downwardly directed lower guide channel 49. The rear vertical wall 42 at its lower end extends laterally to form a lower supporting platform 50, descending rearwardly to permit water to drain into the tub 11. The forward vertical wall 41 terminates at its lower edge in an outer foot 51 and the lower supporting platform 50 terminates in an inner foot 52. If desired, gaskets of a material such as rubber may be placed under the outer foot 51 and the inner foot 52.

Referring particularly to FIGS. 5–10, a guide member 59 is shown comprising a body 60 in the form of a clevis at one end comprising a pair of flanges 61 and 62 defining a channel 63 therebetween. An arm 64 extends longitudinally from the flange 61. At the end of the arm 64 is a lateral web 65 having a guide flange 66 at its end directed vertically and substantially perpendicularly to the lateral web 65. The flanges 61 and 62 are provided with apertures 67 and 68 of rectangular cross-section for receiving a retaining pin 71. The retaining pin 71 comprises a head flange 72 and a pin 73 of rectangular cross-section extending therefrom. The pin has a split end 74 for securing the pin 71. The aperture 68 is provided with a recess 69 on one side to receive the head flange 72 of the retaining pin 71.

Figure 4:
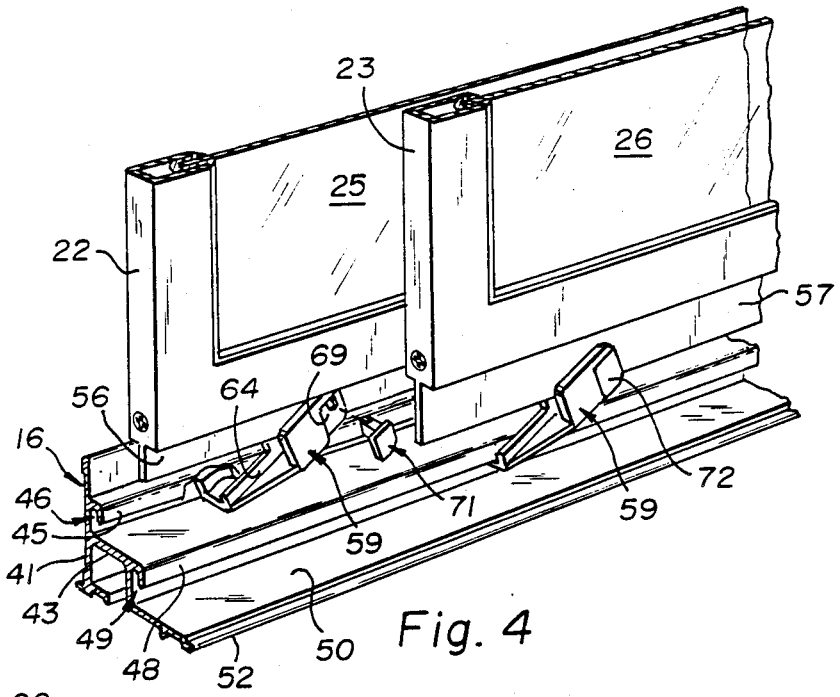
FIG. 4 is a perspective view of a sill track illustrating the mounting of the guide thereon.
Figure 5:
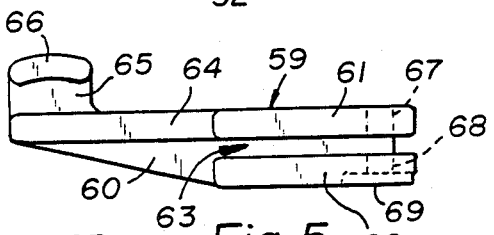
FIG. 5 is a top view of a guide assembly.
Figure 6:
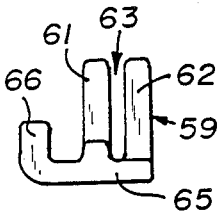
FIG. 6 is an end view of the guide assembly shown in FIG. 5.
Figure 7:
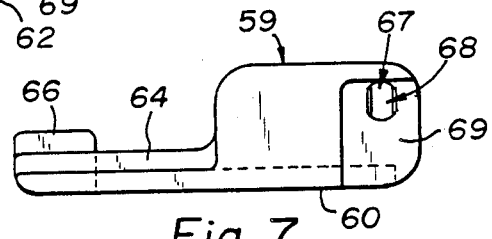
FIG. 7 is a side elevational view of the guide assembly shown in FIGS. 5 and 6.
Figure 8:
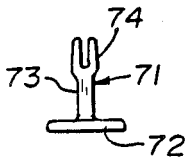
FIG. 8 is an elevational view of a fastening member.
Figure 9:
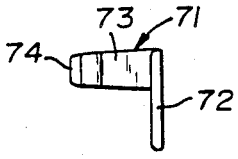
FIG. 9 is a side view of the fastening member.
Figure 10:
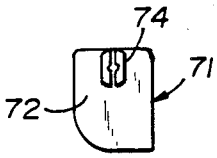
FIG. 10 is a top view of the fastening member shown in FIGS. 8 and 9.

Referring to FIGS. 2, 3 and 4, the method of installing the guide members 59 is shown. As shown particularly in FIG. 2, the guide member 59 is inserted by first rotating it about its longitudinal axis and inserting the guide flange 66 into the guide channel 49 or the guide channel 46. The guide member 59 is then rotated about its longitudinal axis in the opposite direction until the guide flange 66 is retained within the guide channels 46 or 49. The guide flange 56 or 57 of the door bottom is then brought down and its edge inserted into the channel 63 of the guide member 59. The pin shaft 73 of the retaining pin 71 is then inserted through the apertures 67 and 68 of the guide member 59, and through an aperture provided near the edge of each of the guide flanges 56 and 57.

The head flange 72 becomes recessed in the recess 69 and the retaining pin 71 is affixed in position by the split end 74, the two bifurcations of which are compressed together and engage detents provided in the aperture 67. After the guide members 59 are hingedly connected to the guide flanges 56 and 57, they are no longer free to rotate about their longitudinal axes. As a result, the guide flanges 66 are retained within the guide channels 46 and 49. The lateral webs 65 of the guide member 59 are slidably supported on the supporting platforms 43 and 50, thereby preventing the guide flanges 66 from escaping from the guide channels 46 and 49. As each door rolls along its track 29 or 33, the guide members 59 retain the lower portion of the doors in position and prevent lateral movement. If the door should encounter vertical unevenness in the supporting tracks, if one track is slightly higher at one end than at the other, or if bumps are encountered, the end of the guide member affixed to the guide flanges 56 and 57 may rise, or fall. When this occurs, the guide members revolve about the retaining pin 71 to permit the vertical movement, but do not rotate about their longitudinal axis. Consequently, the guide flanges 66 remain in the guide channels 46 and 49 and continue to restrain the lower portions of the doors laterally.

The sill track 16 of the invention may be formed of extruded aluminum or of any of suitable material. The guide member 59 and retaining pin 71 may be formed of any suitable material such as plastics, including polystyrene, nylon, polyvinyl chloride, and any of a large number of plastic materials.

It is to be understood that the invention is not to be limited to the exact details of construction or operation or materials shown and described, as obvious modifications and equivalents will be apparent to one skilled in the art.

Invention is claimed as follows:

1. In a shower door assembly including a fixed upper supporting track, a door having means at the upper end thereof engaging said upper supporting track and permitting movement of said door along said track, the improvement providing means for guiding the lower end of said door and restraining lateral movement comprising a sill track fixed below said door and extending substantially parallel to said upper supporting track, said sill track having means defining a downwardly opening guideway channel and supporting means positioned below said channel, a downwardly directed guide flange extending from the bottom of said door having an aperture provided therein, and an elongate guide member having a pair of substantially parallel flanges at one end defining a channel therebetween, each flange having an aperture provided therein, the guide flange of said door being received in the channel of said guide member, a pin extending through the apertures of said guide member and through the aperture of the guide flange of said door and maintaining said guide flange and said guide member in hinged relationship and restraining said guide member from rotation about an axis parallel to said guide flange, the other end of said guide member having a lateral web extending therefrom and a vertical guide flange extending from and substantially perpendicular to said web, said web being slidably supported by the supporting means of said sill track, said vertical guide flange being slidably retained in the channel of said sill track, whereby said door is free to move along said supporting track and said sill, and the lower end of said door is guided along said sill track and restrained from substantially lateral movement with respect thereto.

2. In a shower door assembly according to claim 1, the improvement wherein the supporting means of said sill track is a supporting platform extending along the length of said sill track.

3. In a shower door assembly according to claim 2, the improvement wherein said pin has an enlarged head at one end and the other end is split, and where an aperture of one of the parallel flanges of said guide member is provided with a detent to engage said split end.

4. In a shower door assembly according to claim 2, the improvement wherein a surface of one of the parallel flanges of said guide member has a recess to receive the head of said pin.

5. In a shower door assembly according to claim 2, the improvement wherein said guide member and said pin are formed of a plastic material.

* * * * *